US010309589B2

(12) United States Patent
Peterson et al.

(10) Patent No.: US 10,309,589 B2
(45) Date of Patent: Jun. 4, 2019

(54) LIGHT VECTORING APPARATUS

(71) Applicant: Rohinni, Inc., Coeur d'Alene, ID (US)

(72) Inventors: Cody Peterson, Hayden, ID (US); Monica Hansen, Santa Barbara, CA (US); Justin Wendt, Post Falls, ID (US); Clint Adams, Coeur d' Alene, ID (US); Andrew Huska, Liberty Lake, WA (US)

(73) Assignee: Rohinni, LLC, Coeur d'Alene, ID (US)

( * ) Notice: Subject to any disclaimer, the term of this patent is extended or adjusted under 35 U.S.C. 154(b) by 161 days.

(21) Appl. No.: 15/154,478

(22) Filed: May 13, 2016

(65) Prior Publication Data

US 2017/0328524 A1 Nov. 16, 2017

(51) Int. Cl.

| | |
|---|---|
| ***F21K 9/65*** | (2016.01) |
| ***F21V 3/04*** | (2018.01) |
| ***F21V 7/00*** | (2006.01) |
| ***H01H 13/70*** | (2006.01) |
| *F21Y 101/00* | (2016.01) |

(52) U.S. Cl.

CPC ..... *F21K 9/65* (2016.08); *F21V 3/04* (2013.01); *F21V 7/0008* (2013.01); *H01H 13/70* (2013.01); *F21Y 2101/00* (2013.01)

(58) Field of Classification Search

CPC . F21K 9/65; F21V 3/04; F21V 7/0008; F21Y 2101/00; H01H 13/70

See application file for complete search history.

(56) References Cited

U.S. PATENT DOCUMENTS

| | | | | |
|---|---|---|---|---|
| 8,636,379 | B2 | 1/2014 | Meyer et al. | |
| 9,633,883 | B2 * | 4/2017 | Huska | H01L 33/62 |
| 2006/0268571 | A1 | 11/2006 | Harada et al. | |
| 2011/0255291 | A1 | 10/2011 | Seki et al. | |
| 2011/0309384 | A1 | 12/2011 | Ito et al. | |
| 2012/0057351 | A1 | 3/2012 | Wilcox et al. | |
| 2012/0161113 | A1 | 6/2012 | Lowenthal et al. | |
| 2012/0243216 | A1 | 9/2012 | Lai et al. | |

OTHER PUBLICATIONS

PCT Search Report and Written Opinion, dated Aug. 31, 2017, for PCT Application No. PCT/US17/32522, 9 pages.

* cited by examiner

*Primary Examiner* — Stephen F Husar
(74) *Attorney, Agent, or Firm* — Lee & Hayes, PLLC

(57) ABSTRACT

An apparatus includes a coverlay layer having a void therein. A backing layer is disposed against a first side of the coverlay layer. A transmission layer is disposed against a second side of the coverlay layer opposite the first side such that a chamber is formed within the void between the transmission layer and the backing layer. The transmission layer includes a first area having a first level of light transmissivity and a second area having a second level of light transmissivity that is greater than the first level of light transmissivity. The transmission layer is oriented so that at least a portion of each of the first area and the second area overlaps the void. A light source is positioned in the chamber between the first area of the transmission layer and the backing layer.

34 Claims, 4 Drawing Sheets

LIGHT VECTORING APPARATUS

CROSS REFERENCE TO RELATED PATENT APPLICATIONS

This application incorporates U.S. patent application Ser. No. 14/939,896, filed on Nov. 12, 2015, entitled "Method and Apparatus for Transfer of Semiconductor Devices," in its entirety by reference.

BACKGROUND

With respect to a surface receiving illumination, the intensity of visible light on that surface may generally depend on the level of reflectivity versus absorption of elements situated in the pathway between the light source and the surface and the original concentration of the light being emitted at the light source. In general, however, the intensity and concentration of light from a light source appears greatest at the source point when there is a direct path between the light source and the receiving surface.

While a stronger illumination is sometimes desirable, there are many instances in which a diffused light is preferred. This is particularly true where a more evenly distributed lighting situation is desired. Regardless, even if a diffusive substrate is positioned between the light source and the receiving surface, a bright spot may still be evident in the diffusive substrate and the receiving surface, indicating the source location, where there is a direct path from the light source to the diffusive substrate.

Moreover, in a situation where there is not a direct path between the light source and the receiving surface and/or where the light source emits light in multiple directions, it may be desirable to direct the light so as to avoid losses generally. Upon formation, light emitting diodes ("LED" hereinafter) generally emit light in multiple directions. In an attempt to minimize light losses, multiple modifications to LEDs have been devised, and are sometimes known as "right-angle," "side-firing," or "side-looker" LEDs. These are LEDs that have been modified to include additional structural features that assist in directing the emitted light in a focused direction, usually at a right angle to mounting position or to emit in a direction parallel to the surface on which the LED is mounted.

Due to the additional structural elements, right-angle LEDs are more bulky than a regular packaged LED, which is already more bulky than an unpackaged LED. Therefore, the surrounding structure in which a right-angle LED is mounted must be large enough to accommodate the larger size. An increase in size, however, generally also indicates an increase in the cost of materials and potentially other manufacturing costs as well.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

Figure 1:
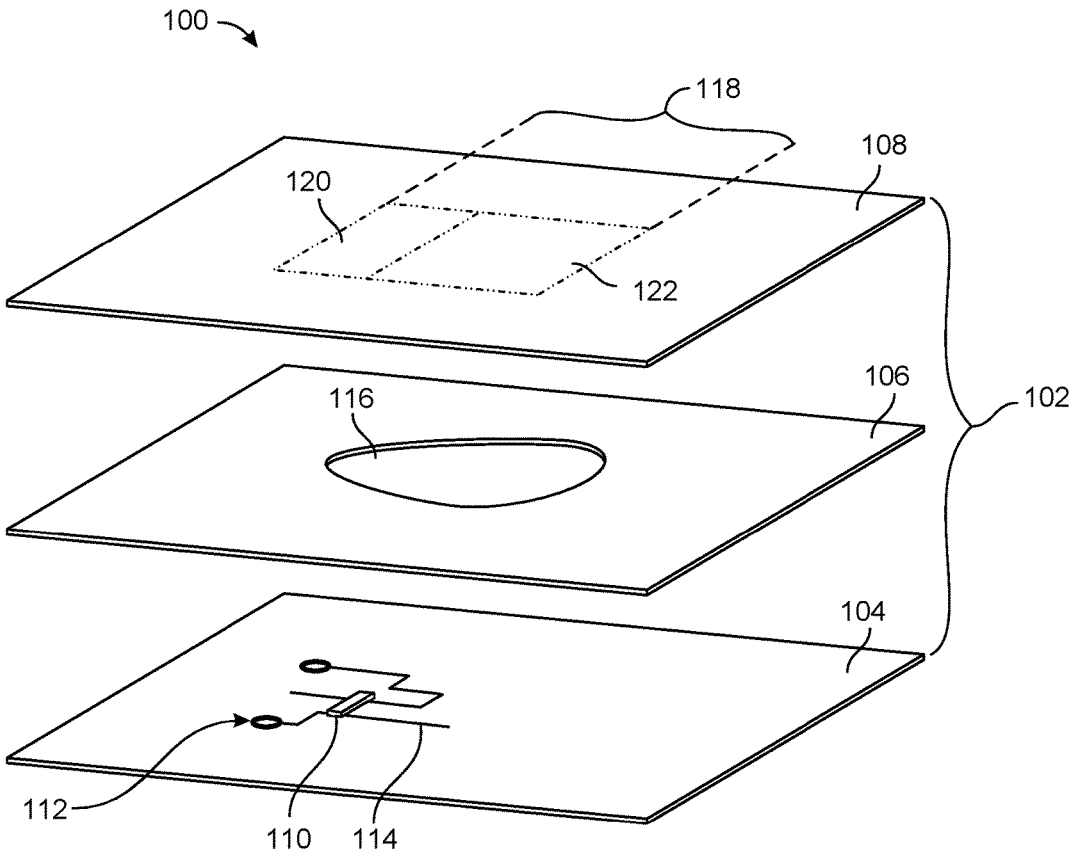
FIG. 1 depicts an exploded view of an illustrative embodiment of a lighting apparatus according to the instant application.

This disclosure is directed to a light vectoring apparatus that directs and diffuses light from a light source prior to the light being emitted into an external environment from the apparatus. In some instances, the chamber structure of the apparatus vectors or directs (i.e., funnels, focuses, or channels) light in a first direction away from the light source and then redirects it in a second direction transverse to the first direction. Similarly, the redirection may be discussed herein as a light emission or transmission position that is laterally displaced from the position of the origination of the light. Further, in some instances, additional light altering materials may be included in the apparatus to assist in diffusing the light.

This disclosure describes techniques and products that are well-suited to lighting using unpackaged LEDs. However, the same techniques and products may also implement lighting with packaged LEDs. For consistency, the use of the term LED herein, may generally indicate an unpackaged LED. An "unpackaged" LED refers to an unenclosed LED without protective features. For example, an unpackaged LED may refer to an LED die that does not include a plastic or ceramic enclosure, pins/wires connected to die contacts (e.g., for interfacing/interconnecting with ultimate circuitry), and/or a sealing (e.g., to protect the die from the environment).

The techniques described herein may implement an LED for lighting in a variety of manners. For example, the LED may be applied to a top surface of the chamber of the apparatus, and/or a bottom surface of the chamber of the apparatus. Moreover, the chamber may contain a single or multiple LEDs therein.

In many instances, the techniques discussed herein are implemented at the assembly level (after LEDs are disposed on a "circuit substrate"). The term "circuit substrate" and/or alternatively, "substrate," may include, but is not limited to: a paper, glass, or polymer substrate formed as a sheet or other non-planar shape, where the polymer—translucent or otherwise—may be selected from any suitable polymers, including, but not limited to, a silicone, an acrylic, a polyester, a polycarbonate, etc.; a circuit board (such as a printed circuit board (PCB)); a string or thread circuit, which may include a pair of conductive wires or "threads" extending in parallel; and a cloth material of cotton, nylon, rayon, leather, etc. The use of either term "circuit substrate" or "substrate" does not necessarily mean that a circuit or circuit trace has yet been added to the substrate. As such, the lighting apparatus may implement a variety of substrates, with or without a circuit, as described herein. The choice of material of the substrates, as discussed herein, may include durable materials, flexible materials, rigid materials, and/or other materials which maintain suitability for the end use of the product. Further, a substrate, such as a circuit substrate, may be formed solely or at least partially of conductive material such that the substrate acts as a conductive circuit for providing electricity to an LED. In an example, a product substrate may be a flexible, translucent polyester sheet having a desired circuit pattern screen printed thereon using a silver-based conductive ink material to form a circuit trace. In some instances, the thickness of the product substrate may be range from about 5 microns to about 80 microns, about 10 microns to about 80 microns, about 10 microns to about 100 microns, and so on.

Further, in the embodiments discussed herein, it is contemplated that the circuit substrates containing LEDs may be prepared using a "direct transfer" process, where an unpackaged LED die is transferred from a wafer or wafer tape directly to a substrate, such as a circuit substrate, and then implemented into an apparatus at assembly, with or without further processing, such as the addition of a phosphor or other down-converting media such as quantum dots or organic dyes. The direct transfer of the unpackaged LED die may significantly reduce the thickness of an end product (in comparison to other techniques), as well as the amount of time and/or cost to manufacture the product substrate.

The fabrication of LEDs typically involves an intricate manufacturing process with a myriad of steps. The fabrication may start with handling a semiconductor wafer. The wafer is diced into a multitude of "unpackaged" LEDs. The "unpackaged" modifier refers to an unenclosed LED device without protective features. An unpackaged LED device may be referred to as an LED die, or just a "die." A single semiconductor wafer may be diced to create multiple dies of various sizes, so as to form upwards of more than 100,000 or even 1,000,000 dies from the semiconductor wafer. For conventional usage, unpackaged dies are then generally "packaged." The "packaged" modifier refers to the enclosure and protective features built into a final LED as well as the interface that enables the die in the package to ultimately be incorporated into a circuit. For example, packaging may involve mounting a die into a plastic-molded lead frame or onto a ceramic substrate, connecting the die contacts to pins/wires for interfacing/interconnecting with ultimate circuitry, and sealing the die with an encapsulant to improve light extraction and protect it from the environment (e.g., dust). Due to the packaging, the LED dies are ready to be "plugged in" to the circuit assembly of the product being manufactured. A product manufacturer then places packaged LEDs in product circuitry. Additionally, while the packaging of on an LED die protects the die from elements that might degrade or destroy the LED device, packaged LED dies are inherently larger (e.g., in some cases, around 10 times the thickness and 10 times the area, resulting in 100 times the volume) than the die found inside the package. Thus, the resulting circuit assembly cannot be any thinner than the packaging of the LED die.

To address the size issue, in many instances the techniques discussed herein implement the "direct transfer" process where an LED die is transferred directly from a wafer or wafer tape to a product substrate. Although in other instances, the techniques may be implemented in other contexts that do not implement a direct transfer process for the LED dies.

While embodiments are described herein in language specific to structural features and/or methodological acts, it is to be understood that the disclosure is not necessarily limited to the specific features or acts described. Rather, the specific features and acts are disclosed herein as illustrative forms of implementing the embodiments.

Illustrative Embodiments of a Lighting Apparatus

In FIG. 1, an apparatus 100 may include a lighting assembly 102. The lighting assembly 102 may be implemented in any apparatus or device in which illumination of a component of the apparatus or device is desired, particularly in a setting where indirect and/or diffused lighting is beneficial. For example, lighting assembly 102 may be used as backlighting for keycaps on a keyboard, for a display device, etc.

As depicted in FIG. 1, lighting assembly 102 may include a backing layer 104, a coverlay layer 106, and a transmission layer 108.

Backing layer 104 may be formed as a substrate from among a variety of materials and have one or more functions. In some instances, backing layer 104 may be a circuit substrate in the assembly 102, which may be entirely incorporated into a housing for a product. Alternatively, backing layer 104 may be a portion of an external frame or housing of a product.

The stiffness of backing layer 104 may vary according to the properties of the material selected. For example, in some instances, backing layer 104 may be formed of a metal plate that is substantially rigid so as to maintain a planar shape, or backing layer 104 may be formed of a thin polymer film that is substantially flexible so as to conform to contours of adjacent elements in the apparatus or device in which lighting assembly 102 is implemented. When using a thin polymer film—translucent or otherwise—the polymer may be selected from any suitable polymers, including, but not limited to, a silicone, an acrylic, a polyester, a polycarbonate, etc. Further, backing layer 104 may be a conventional printed circuit board (PCB).

As a non-limiting example, in FIG. 1, backing layer 104 is depicted as a circuit substrate that carries a light source 110, such as an LED, attached to circuitry 112. Circuitry 112 includes a conductive circuit trace 114. In an embodiments, circuit trace 114 may be formed from a printed conductive ink disposed via screen printing, inkjet printing, laser printing, manual printing, or other printing means. Further, circuit trace 114 may be pre-cured and semi-dry or dry to provide additional stability, while still being activatable for die conductivity purposes. A wet conductive ink may also be used to form circuit trace 114, or a combination of wet and dry ink may be used for circuit trace 114. Alternatively, or additionally, circuit trace 114 may be pre-formed as a wire trace, or photo-etched, or from molten material formed into a circuit pattern and subsequently adhered, embedded, or otherwise secured to backing layer 104.

The material of circuit trace 114 may include, but is not limited to, silver, copper, gold, carbon, conductive polymers, etc. In some instances, circuit trace 114 may include a silver-coated copper particle. A thickness of circuit trace 114 may vary depending on the type of material used, the intended function and appropriate strength or flexibility to achieve that function, the energy capacity, the size of the light source 110 (e.g., LED), etc. For example, a thickness of circuit trace 114 may range from about 5 microns to about 20 microns, from about 7 microns to about 15 microns, or from about 10 microns to about 12 microns.

Note, despite circuitry 112 being depicted as disposed on backing layer 104 in FIG. 1, this depiction is simply an example embodiment in the instant application. It is contemplated, as discussed and depicted further herein, that circuitry 112 may be formed additionally, or alternatively, on transmission layer 108. Moreover, instead of a separate substrate, backing layer 104 may be considered to be the surface of a component that has been preformed for a final product, in which case, circuitry 112 may be printed or added thereon by any suitable means.

As mentioned above, lighting assembly 102 further includes coverlay layer 106. In some instances, coverlay layer 106 may be formed of a polymer film substrate. Additionally, or alternatively, coverlay layer 106 may be formed via printing or screenprinting a liquid material over the surface of backing layer 104. As depicted in FIG. 1, coverlay layer 106 is disposed against backing layer 104, and coverlay layer 106 includes void 116. Void 116 may be a hole/aperture or an empty space cut from or otherwise created in coverlay layer 106 during formation thereof. In lighting assembly 102, coverlay layer 106 is oriented, with respect to backing layer 104, such that light source 110 is disposed within the void 116.

During formation of lighting assembly 102, when backing layer and transmission layer 108 are disposed on opposite sides of coverlay layer 106, a chamber may be formed by virtue of void 116 being sandwiched in the layers. That is, coverlay layer 106 becomes sandwiched between backing layer 104 and transmission layer 108 and the opposing surfaces of backing layer 102 and transmission layer 108 adjacent void 116 form at least a partially enclosed chamber in connection with sidewalls of void 116. As discussed further herein, in some embodiments, the chamber may be fully enclosed.

FIG. 1 illustrates that a least a portion of transmission layer 108 includes a transmission region 118. Further, transmission region 118 is oriented to be adjacent void 116. Transmission region 118 is subdivided into a first area 120 and a second area 122. First area 120 of transmission region 118 has a first light transmissivity level. Second area 122 of transmission region 118 has a second light transmissivity level. The respective light transmissivity levels of first area 120 and second area 122 regard the relative amount of light from the light source 110 that may pass through the first area 120 and second area 122. According to the instant application, the second transmissivity level of second area 122 is greater than the first transmissivity level of first area 120, which means that more light is allowed to transmit via second area 122 than may be transmit via first area 120. In some instances, first area 120 may be completely opaque, or first area 120 may be less than completely opaque, thus allowing a restricted amount of light from light source 110 to pass therethrough. Moreover, in some instances, second area 122 may be a complete aperture through transmission layer 108, in which case, the absence of substrate material in second area 122 of transmission region 118 is ensures that second area 122 is more transmissive to light than first area 120, which does not have a hole/aperture therethrough. Alternatively, instead of a hole/aperture, the substrate material of transmission layer 108 in second area 122 may include a translucent material that is more transmissive to light than the substrate material of the first area 120 in transmission layer 108.

Turning to FIGS. 2A-2D, FIGS. 2A-2D depict a top view of stages 200, 202, 204, and 206, respectively, in an assembly of at least a portion of an apparatus according to the instant application. The following description is not intended to mandate any particular order of assembly, but rather is merely a convenient way to describe the overlapping layers of the apparatus.

Figure 2A:
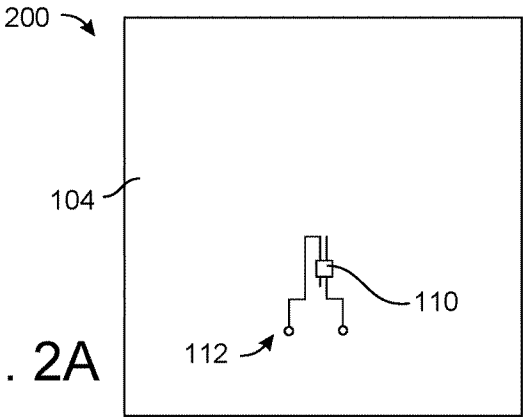
FIG. 2A depicts a top view of features of a lighting apparatus according to an embodiment of the instant application.
Figure 2B:
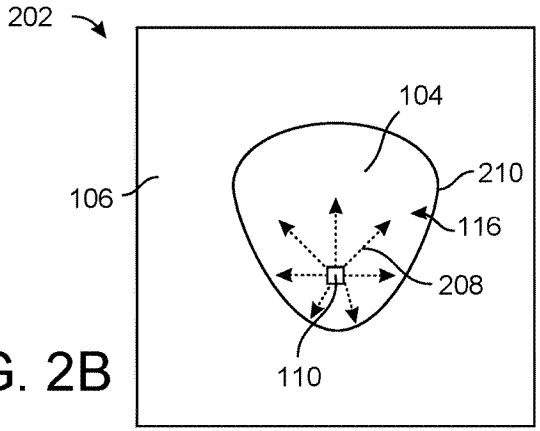
FIG. 2B depicts a top view of additional features of a lighting apparatus according to an embodiment of the instant application.

In FIG. 2A, first stage 200 is depicted showing backing layer 104 including light source 110 disposed on circuitry 112. First stage 200 may, in some instances, include the deposition on circuitry 112 and light source 110 onto backing layer 104. In FIG. 2B, second stage 202 is depicted showing a top view of coverlay layer 106 disposed on backing layer 104, such that light source 110 is located in void 116. For illustrative purposes, light rays emitted from light source 110 are depicted in FIG. 2B, as dotted arrows 208. Furthermore, light rays 208 are depicted as emanating away from light source 110 in a direction toward sidewall 210 of void 116.

Figure 2C:
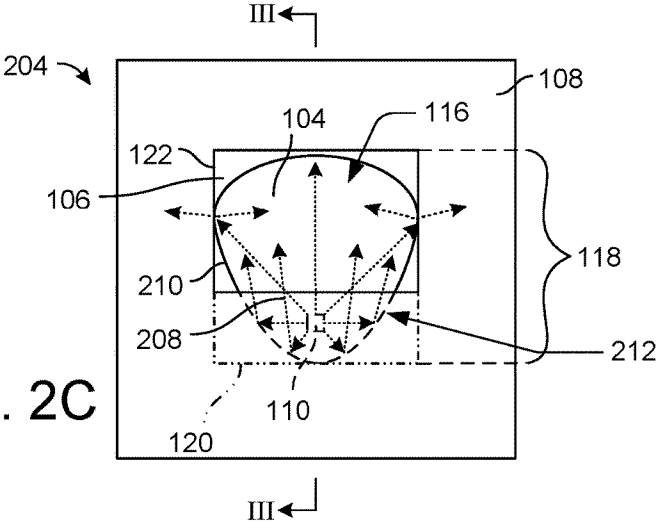
FIG. 2C depicts a top view of additional features of a lighting apparatus according to an embodiment of the instant application.

A third stage 204 is shown in FIG. 2C, depicting transmission layer 108 disposed on coverlay layer 106 (seen at peripheral edges of void 116) so as to also overlap backing layer 104. In this third stage 204, chamber 212 is formed, as discussed above, by the sandwiching of void 116 between backing layer 104 and transmission layer 108. Note, that in FIG. 2C, dashed lines are intended to depict hidden contours and boundaries of features beneath transmission layer 108, while solid lines are intended to depict visible boundaries. For example, in some instances, as depicted in FIG. 2C, second area 122 of transmission region 118 is an aperture, and as such, the portion of sidewall 210 of void 116 showing within second area 122 is depicted with a solid line, while the portion of sidewall 210 of void 116 showing within first area 120 of transmission region 118 is depicted with a dashed line. Similarly, light source 110 is depicted with a dashed line to indicate that light source 110 is hidden beneath the substrate material of first area 120.

Due to the partial enclosure of light source 110, and depending on the level of translucency or opacity of first area 120, light rays 208 may not be directly visible above light source 110. Instead, even in an embodiment where first area 120 is not completely opaque, light rays 208 may be reflected in a first general direction away from light source 110 and toward second area 122 so as to transmit out of chamber 212 via second area 122 in a second general direction that is transverse to the first general direction. In some instances, light rays 208 may be focused, vectored, or channeled away from light source 120 to transmit via second area 122 by reflecting off of one or more surfaces in chamber 212, including: the floor beneath light source 110 (i.e., the surface of backing layer 104 facing void 116), the ceiling above light source 110 (i.e., the surface of first area 120 of transmission region 118 of transmission layer 108 facing void 116), or sidewall 210 of void 116.

Figure 2D:
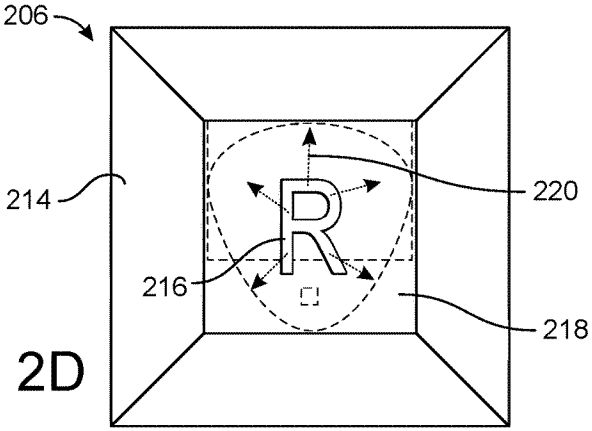
FIG. 2D depicts a top view of additional features of a lighting apparatus according to an embodiment of the instant application.

FIG. 2D depicts a fourth stage 206 including an additional feature of a device or apparatus into which a lighting assembly may be implemented. In some instances, lighting assembly 102 may be incorporated into a device with a cover such as cover 214 in FIG. 2D. Cover 214 may be, for example, as illustrated a keycap for a keyboard. However, this implementation is non-limiting and is only considered an example of a cover of a device for purposes of convenient illustration. It is contemplated that there are many devices that require lighting and a cover may be implemented for diffused lighting or other desirable effects in many different types of devices/apparatuses, in which a lighting assembly, such as lighting assembly 102, may be used. As in FIG. 2C, dashed lines in FIG. 2D also represent hidden elements beneath cover 214 to provide perspective of the orientation of features in the depicted layers of the structure.

In an embodiment, cover 214 may include a translucent portion 216, depicted in FIG. 2D as a letter "R" like on a keycap cover for a keyboard, and a non-translucent portion 218, which may include the remainder of the cover 214 outside of portion 216. In this manner, light rays 208, which were reflected and transmitted out of chamber 212, as shown in FIG. 2C, may pass through portion 216 of cover 214 as diffused or indirect light rays 220. Additionally, and/or alternatively, the respective levels of translucency of portion 216 and portion 218 may be swapped, such that the "R" of portion 216 allows no light to pass therethrough, while all or some of portion 218 is translucent. Furthermore, in some instances, an entirety of the cover 214 may be translucent so as to be completely illuminated, or even transparent. For example, lighting assembly 102 may be incorporated into a light bulb or other lighting apparatus, where the cover is transparent, such as a clear glass, so that the cover allows the indirect (or redirected) light from the lighting assembly to emanate therethrough essentially unhindered. In another example embodiment, the cover 214 may be formed from a phosphor compound material or from a material having a phosphor coating, so as to modify the light as it is transmitted. It is contemplated that other light modifying materials (e.g. color changing materials, quantum dots, color filters, etc.) may be incorporated within any of the features of lighting assembly 102 or cover 214 so as to modify the emitted light from light source 110.

Figure 3:
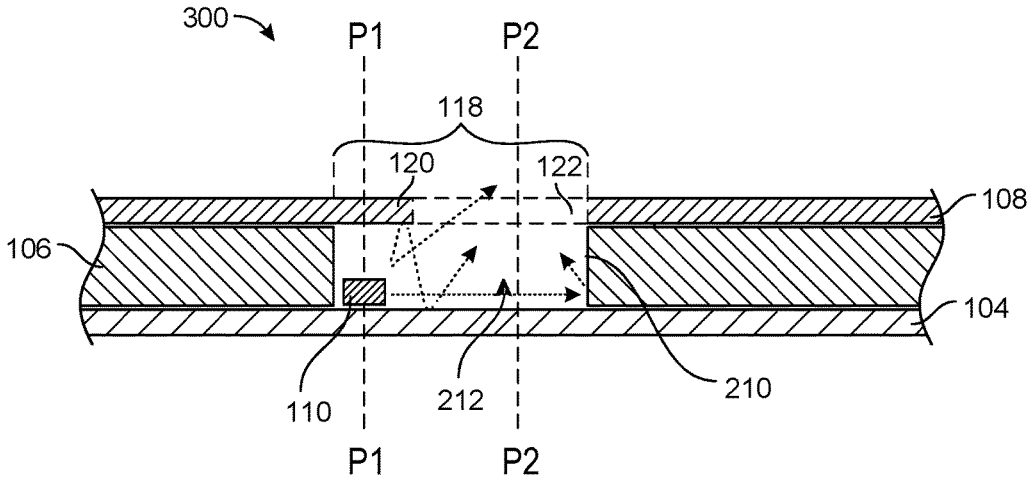
FIG. 3 depicts a cross-sectional view of the lighting apparatus at line III-III according to the embodiment of FIG. 2C.

A cross-sectional view 300 of the lighting assembly 102 taken at line III-III shown in FIG. 2C is depicted in FIG. 3. As depicted, light source 110 may be attached to backing layer 104 (circuitry 112 not shown in FIG. 3). In some instances, light source 110 may further be located at a position P1, which is oriented in vertical alignment with first area 120. Note that the substrate material of transmission layer 108 extends across a vertical space above light source 110 as first area 120. The surface of first area 120 may have reflective properties. For example, first area 120 may include a coating of reflective material facing light source 110, or the material of the entirety of transmission layer 108 may be reflective generally. Likewise, the "floor" or the surface of backing layer 104 may have reflective properties as well, either by a material coating or by the inherent properties thereof.

Also depicted in FIG. 3 is a set of dashed lines extending through second area 122. The absence of material explicitly shown in second area 122 indicates that (as discussed above) that second area 122 may be an aperture through transmission layer 108. Alternatively, the dashed lines are intended to show that the transmission layer 108 may actually be continuous in second area 122 of transmission region 118. In such a case, second area 122 is still more light transmissive than first area 120. As shown, light rays (dotted lines) reflect within chamber 212 to exit chamber 212 via second area 122, which is vertically aligned at position P2. Thus, the light rays are generally directed in a first lateral direction away from light source 110 at position P1 and are transmitted out of chamber 212 at position P2, which is laterally displaced from P1, so that the light is directed generally in a second direction transverse to the first direction.

Figure 4:
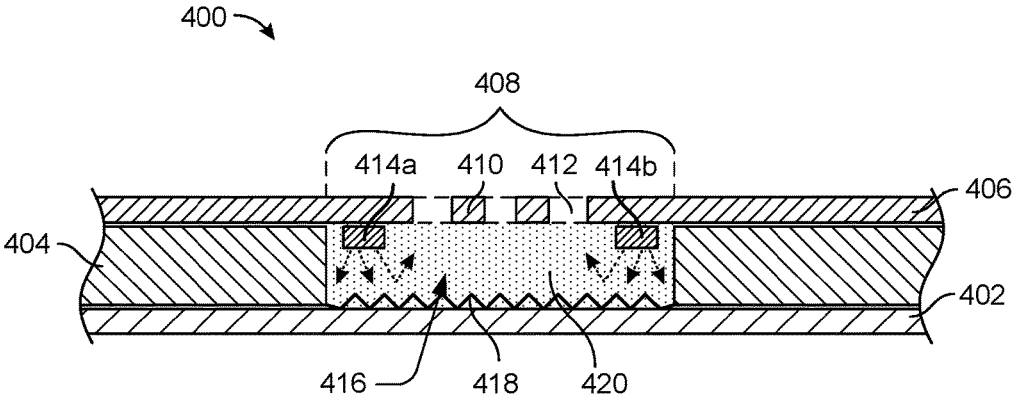
FIG. 4 depicts a cross-sectional view of a lighting apparatus according to an embodiment of the instant application.

A cross-section of an embodiment of a lighting assembly or apparatus 400 is depicted in FIG. 4. In FIG. 4, lighting assembly 400 may include a backing layer 402 sandwiching a coverlay layer 404 with a transmission layer 406. Transmission layer 406 may include a transmission region 408 having one or more interconnected first areas 410 and one or more second areas 412. First area 410 and second area 412 may have similar levels of light transmissivity as are described above with respect to similarly discussed first area 120 and second area 122. Furthermore, in FIG. 4, transmission layer 406 has light sources 414*a* and 414*b* attached thereto with circuitry (not shown, but like circuitry 112 previously discussed).

Also depicted in FIG. 4 is chamber 416 that is formed with a void in coverlay layer 404. Light rays are emitted from light sources 414*a* and 414*b* into chamber 416. Light rays may reflect around chamber 416 via the floor, ceiling, and sidewall(s). In some instances, a coating 418, which may have texture may be disposed on the floor of chamber 416 to assist in reflection and diffusion of the light. Additionally, and/or alternatively, chamber 416 may be at least partially filled with a light modifying material 420, such as phosphor or other diffusive and/or reflective material. Here, again, in FIG. 4, the concept of light being transmitted from a position laterally displaced from a location of the light source(s) is implemented.

Figure 5:
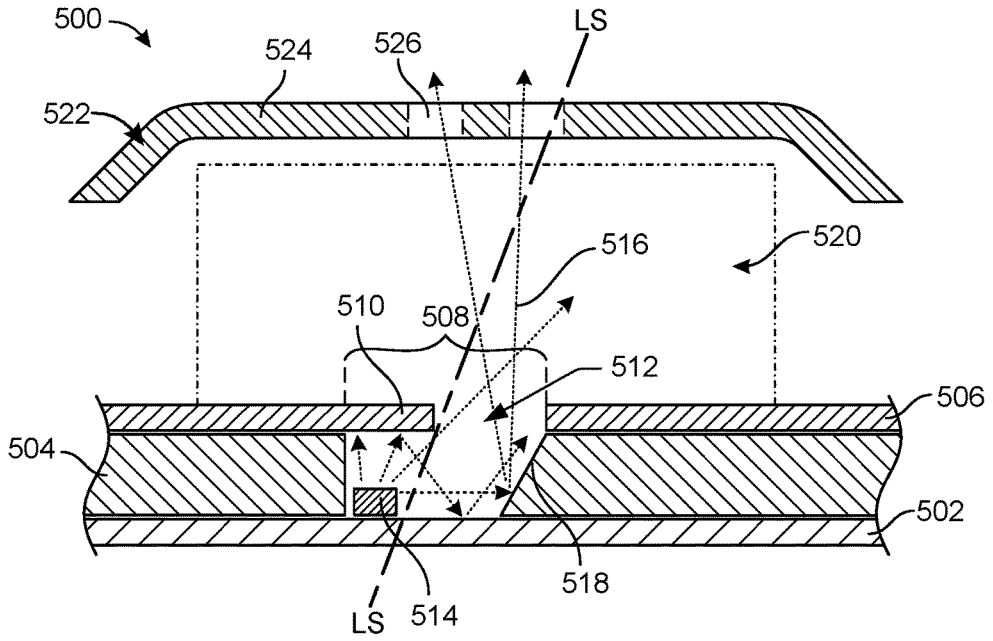
FIG. 5 depicts a cross-sectional view of a lighting apparatus according to an embodiment of the instant application.

In FIG. 5, another cross-section of a lighting apparatus 500 shows a backing layer 502 sandwiching a coverlay layer 504 with a transmission layer 506. A transmission region 508 of transmission layer 506 may include a first area 510 having a first level of light transmissivity and a second area 512 having a second level of light transmissivity that is greater than the first level of light transmissivity. Light source 514, such as an LED, is disposed on backing layer 502, and emits light rays 516 that may reflect off of sidewall 518, which is formed from a void in coverlay layer 504, for example. Note that sidewall 518 is beveled. The beveling of sidewall 518 may be achieved via a laser or other angled cutting means, for example. The beveled edge of sidewall 518 may create a naturally reflective surface and assist is transmitting light rays 516 away from light source 514 in a transverse direction outward through second area 512. Light rays 516 may provide illumination in a space 520 between transmission layer 506 and a cover 522.

Similar to cover 214, cover 522 may include a non-translucent portion 524 and a translucent portion 526. In this manner, light rays 516, which were reflected and transmitted through second area 512 and into space 520, may pass through portion 526 of cover 522 as diffused or indirect light rays 516. Light rays 516 may be appropriately be referred to as indirect because there is no line of sight LS directly from translucent portion 526 of cover 522 to light source 514, as indicated by the line LS shown in FIG. 5. That is, the size of space 520 and/or the distance between cover 522 and a border edge of first area 510 and second area 512 may be such that a line LS from translucent portion 526 would not intersect with light source 510. In this manner, a bright spot from visible direct lighting through translucent portion 526 may be eliminated or substantially minimized.

Figure 6:
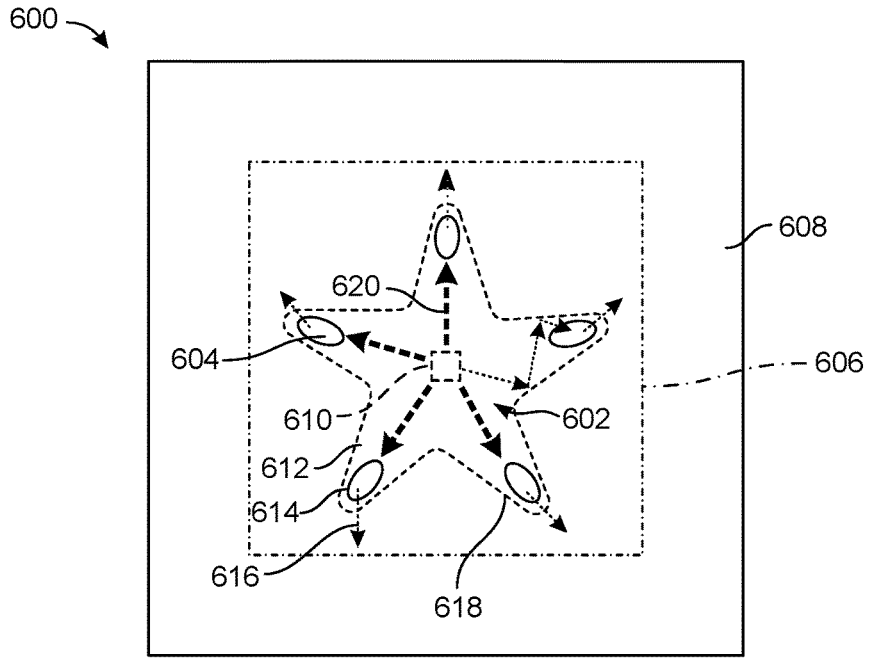
FIG. 6 depicts a top view of a lighting apparatus according to an embodiment of the instant application.

Apparatus 600 of FIG. 6 illustrates a chamber 602 (that is hidden as illustrated by the dashed star-shaped perimeter line). Chamber 602 is formed with backing layer 604, a void in a coverlay layer 606 (hidden), and a transmission layer 608. Light is emitted into chamber 602 via light source 610 located substantially in the center of the star-shaped chamber 602. Light from light source 610 may be blocked partially or entirely by a first area 612 of transmission layer 608 in the same manner as described above with respect to first areas 120, 410, and 510. Further, in FIG. 6, second areas 614 (i.e., the ovular portions) may be more light transmissive than first area 612 so as to allow light rays 616, which have generally been vectored, channeled, or funneled off of sidewall 618 of chamber 602 in a first direction 620 away from light source 610, to pass into the atmosphere via the second areas 614 in a second direction transverse to the first direction.

Therefore, it is contemplated that the shape of the chamber need not be limited to the partially parabolic shape depicted in FIGS. 1 and 2B-2D. Instead, alternate shapes are contemplated, such as the star of FIG. 6 or other shapes including square, rectangle, triangle, circle, etc. To avoid dampening of light rays and loss of light to corners of a shape of a chamber, shapes without corners are implemented in some instances.

Conclusion

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. An apparatus, comprising:

a coverlay layer including a void therein;

a backing layer disposed against a first side of the coverlay layer; and a transmission layer disposed against a second side of the coverlay layer opposite the first side such that a chamber is formed within the void between the transmission layer and the backing layer, the transmission layer including a first area having a first level of light transmissivity and a second area having a second level of light transmissivity that is greater than the first level of light transmissivity, and the transmission layer being oriented so that at least a portion of each of the first area and the second area overlaps the void, wherein a light source is positioned in the chamber between the first area of the transmission layer and the backing layer.

2. The apparatus according to claim 1, wherein at least a portion of a surface of the first area of the transmission layer that is facing the void is at least partially reflective.

3. The apparatus according to claim 1, wherein at least a portion of the second area of the transmission layer that is facing the void includes light modifying material.

4. The apparatus according to claim 1, wherein the second area of the transmission layer that is facing the void includes an aperture therethrough.

5. The apparatus according to claim 1, wherein the light source is electrically connected to a circuit trace disposed on the backing layer.

6. The apparatus according to claim 1, wherein the transmission layer is a circuit substrate to which the light source is electrically connected.

7. The apparatus according to claim 1, wherein interior surfaces of the chamber are at least partially reflective.

8. The apparatus according to claim 1, wherein the chamber is at least partially filled with a light modifying material.

9. The apparatus according to claim 1, further comprising a cover covering at least a portion of the chamber and having a translucent portion, the cover being disposed adjacent the transmission layer such that light that passes through the second area of the transmission layer is emitted into an external environment.

10. The apparatus according to claim 1, wherein an inner sidewall of the void is continuous so as to define a perimeter shape having no corners.

11. The apparatus according to claim 1, wherein a floor of the chamber includes at least one of a textured surface or a light modifying material.

12. An apparatus, comprising:

a chamber;

a light source positioned in the chamber;

a substrate disposed against the chamber, the substrate including a first region having a first level of light transmissivity and a second region having a second level of light transmissivity that is greater than the first level, the first region of the substrate and the light source being aligned in a first position with respect to the apparatus, light exiting the chamber via the second region of the substrate located at a second position with respect to the apparatus, and the second position being laterally displaced from the first position; and a cover that covers at least the second region of the substrate, the cover including a translucent portion that allows light from the light source to pass through to an external environment, wherein the first region of the substrate extends over the light source such that the light source does not directly illuminate the cover.

13. The apparatus according to claim 12, wherein the chamber includes a light diffusion region in which the light from the light source is at least one of diffused or reflected, the light diffusion region being aligned with the second position.

14. The apparatus according to claim 12, wherein the first region of the substrate includes a reflective surface facing the light source.

15. The apparatus according to claim 12, wherein the second region of the substrate includes light modifying material.

16. The apparatus according to claim 12, wherein the second region of the substrate has an aperture that is aligned with the second position that is laterally displaced from the first position.

17. The apparatus according to claim 12, wherein the substrate is a coverlay, wherein the apparatus further comprises a circuit substrate disposed on a side of the chamber that is opposite the coverlay, and wherein the light source is electrically connected to the circuit substrate.

18. The apparatus according to claim 12, wherein the substrate is a circuit substrate to which the light source is electrically connected.

19. The apparatus according to claim 12, wherein interior surfaces of the chamber are at least partially reflective.

20. The apparatus according to claim 12, wherein the chamber is at least partially filled with a light modifying material.

21. The apparatus according to claim 12, wherein at least a portion of an inner sidewall of the chamber is beveled to reflect light from the light source through the second region of the substrate.

22. The apparatus according to claim 12, wherein an inner sidewall of the chamber is continuous so as to define a perimeter shape having no corners.

23. The apparatus according to claim 12, wherein a floor of the chamber includes at least one of a textured surface or a light modifying material.

24. An apparatus, comprising:

a light source;

a chamber including a light diffusion portion shaped to vector light in a first direction away from a position of the light source; and a substrate at least partially covering the chamber, the substrate having a transmission region through which the light from the light diffusion portion is vectored in a second direction that is transverse to the first direction.

25. The apparatus according to claim 24, further comprising a cover disposed over the chamber and the substrate, wherein the light being vectored in the second direction is emitted into an external environment via the cover.

26. The apparatus according to claim 24, further comprising a circuit substrate including a circuit trace to which the light source is electrically connected, wherein a surface of the circuit substrate defines a portion of a ceiling or a floor of the chamber.

27. The apparatus according to claim 24, wherein an inner sidewall of the chamber is continuous so as to define a perimeter shape having no corners.

28. The apparatus according to claim 24, wherein a floor of the chamber includes at least one of a textured surface or a light modifying material.

29. The apparatus according to claim 24, wherein the chamber is at least partially filled with a light modifying material.

30. The apparatus according to claim 24, wherein at least a portion of an inner sidewall of the chamber is beveled to reflect light from the light source in the second direction.

31. The apparatus according to claim 24, wherein interior surfaces of the chamber are at least partially reflective.

32. The apparatus according to claim 24, wherein at least a portion of a surface of the light diffusion portion is at least partially reflective to assist in vectoring the light.

33. The apparatus according to claim 24, wherein at least a portion of the transmission region of the substrate includes light modifying material.

34. The apparatus according to claim 24, wherein the transmission region of the substrate includes an aperture therethrough.

* * * * *